US009724804B2

(12) United States Patent
Mazyar

(10) Patent No.: US 9,724,804 B2
(45) **Date of Patent: *Aug. 8, 2017**

(54) METHODS OF FORMING CUTTING ELEMENTS BY OXIDIZING METAL IN INTERSTITIAL SPACES IN POLYCRYSTALLINE MATERIAL

(71) Applicant: Baker Hughes Incorporated, Houston, TX (US)

(72) Inventor: Oleg A. Mazyar, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/593,810

(22) Filed: Jan. 9, 2015

(65) Prior Publication Data

US 2015/0114846 A1 Apr. 30, 2015

Related U.S. Application Data

(63) Continuation of application No. 13/464,483, filed on May 4, 2012, now Pat. No. 8,961,630.

(51) Int. Cl.
*B24D 3/10* (2006.01)
*B24D 18/00* (2006.01)
(Continued)

(52) U.S. Cl.
CPC ..... *B24D 3/10* (2013.01); *B24D 18/009* (2013.01); *B24D 18/0018* (2013.01); *B24D 99/005* (2013.01)

(58) Field of Classification Search
CPC ..... B24D 3/10; H01M 6/14; C22B 23/00
See application file for complete search history.

(56) References Cited

U.S. PATENT DOCUMENTS 3,764,493 A 10/1973 Nicks et al.
3,772,168 A 11/1973 Dillenberg
(Continued)

FOREIGN PATENT DOCUMENTS

JP 59219500 A 12/1984
WO 2005110648 A2 11/2005
(Continued)

OTHER PUBLICATIONS

Ali et al., Electrodeposition of Co—Al Alloys of Different Composition from the AlCl3—BPC—CoCl2 Room Temperature Molten Salt, Electrochimica Acta, vol. 42, No. 12 (1997) pp. 1819-1828.
(Continued)

*Primary Examiner* — Pegah Parvini
(74) *Attorney, Agent, or Firm* — TraskBritt

(57) ABSTRACT

Methods of forming a cutting element include disposing a volume of polycrystalline material adjacent a liquid electrolytic solution and applying an electrical between the polycrystalline material and a cathode in contact with the liquid electrolytic solution to increase an oxidation state of the metal catalyst material. The polycrystalline material includes interbonded grains of hard material and metal catalyst particles in the interstitial spaces between adjacent grains of hard material. Some methods include forming a barrier over a portion of a surface of a volume of polycrystalline material.

20 Claims, 5 Drawing Sheets

(51) Int. Cl.

| | |
|---|---|
| ***B24D 99/00*** | (2010.01) |
| *H01M 6/14* | (2006.01) |
| *C22B 23/00* | (2006.01) |

(56) References Cited

U.S. PATENT DOCUMENTS

| | | | | |
|---|---|---|---|---|
| 4,076,794 | A | 2/1978 | Smith | |
| 4,132,837 | A | 1/1979 | Soffer | |
| 4,224,380 | A | 9/1980 | Bovenkerk et al. | |
| 4,234,333 | A | 11/1980 | Ghandehari et al. | |
| 4,349,423 | A | 9/1982 | Nutzel et al. | |
| 4,572,722 | A | 2/1986 | Dyer | |
| 6,406,611 | B1 | 6/2002 | Engelhaupt et al. | |
| 6,410,085 | B1 | 6/2002 | Griffin et al. | |
| 6,435,058 | B1 | 8/2002 | Matthias et al. | |
| 6,481,511 | B2 | 11/2002 | Matthias et al. | |
| 6,544,308 | B2 | 4/2003 | Griffin et al. | |
| 6,562,462 | B2 | 5/2003 | Griffin et al. | |
| 6,585,064 | B2 | 7/2003 | Griffin et al. | |
| 6,589,640 | B2 | 7/2003 | Griffin et al. | |
| 6,592,985 | B2 | 7/2003 | Griffin et al. | |
| 6,601,662 | B2 | 8/2003 | Matthias et al. | |
| 6,739,214 | B2 | 5/2004 | Griffin et al. | |
| 6,749,033 | B2 | 6/2004 | Griffin et al. | |
| 6,797,326 | B2 | 9/2004 | Griffin et al. | |
| 6,861,098 | B2 | 3/2005 | Griffin | |
| 6,861,137 | B2 | 3/2005 | Griffin | |
| 6,878,447 | B2 | 4/2005 | Griffin | |
| 6,962,214 | B2 | 11/2005 | Hughes et al. | |
| 7,757,792 | B2 | 7/2010 | Shamburger | |
| 2002/0139584 | A1 | 10/2002 | Hughes et al. | |
| 2003/0162648 | A1* | 8/2003 | Middlemiss | C04B 35/628 428/698 |
| 2005/0115744 | A1 | 6/2005 | Griffin et al. | |
| 2005/0129950 | A1 | 6/2005 | Griffin et al. | |
| 2007/0169419 | A1 | 7/2007 | Davis et al. | |
| 2010/0095602 | A1 | 4/2010 | Belnap et al. | |
| 2010/0108403 | A1 | 5/2010 | Keshavan | |
| 2010/0239483 | A1 | 9/2010 | Middlemiss | |
| 2011/0024201 | A1 | 2/2011 | Scott et al. | |
| 2011/0031034 | A1 | 2/2011 | DiGiovanni et al. | |
| 2011/0042149 | A1 | 2/2011 | Scott et al. | |
| 2011/0045360 | A1* | 2/2011 | Deguchi | H01M 4/0435 429/341 |
| 2011/0056141 | A1 | 3/2011 | Miess et al. | |
| 2011/0061942 | A1 | 3/2011 | DiGiovanni | |
| 2011/0088954 | A1 | 4/2011 | DiGiovanni et al. | |
| 2011/0283628 | A1 | 11/2011 | Saridikmen et al. | |
| 2012/0055717 | A1 | 3/2012 | Liversage et al. | |
| 2012/0097458 | A1 | 4/2012 | Voronin et al. | |
| 2012/0103696 | A1 | 5/2012 | DiGiovanni | |
| 2013/0291447 | A1 | 11/2013 | Mazyar | |

FOREIGN PATENT DOCUMENTS

| | | | |
|---|---|---|---|
| WO | 2007042920 | A1 | 4/2007 |
| WO | 2011080685 | A2 | 7/2011 |
| WO | 2012019996 | A1 | 2/2012 |

OTHER PUBLICATIONS

Burke et al., Formation of Hydrous Oxide Films on Cobalt Under Potential Cycling Conditions, J. Electroanal. Chem., vol. 132 (1982), pp. 247-261.

Burke et al., The Electrocatalytic Behavior of Cobalt (and Iron) Electrodes at Low Potential in Base, J. Electrochem. Soc., vol. 138, No. 1, Jan. 1991, pp. 88-94.

Burstein et al., The Analysis of Anodic Films Formed on Cobalt in Bicarbonate and Borate Electrolytes, Corrosion Science, vol. 20 (1980), pp. 989-995.

Buzzeo et al., Non-Haloaluminate Room-Temperature Ionic Liquids in Electrochemistry—A Review, ChemphysChem, vol. 5 (2004), pp. 1106-1120.

Carlin et al., Microelectrode Evaluation of Transition Metal-Aluminum Alloy Electrodepositions in Chloroaluminate Ionic Liquids, J. Electrochem. Soc., vol. 145, No. 5, May 1998, pp. 1598-1607.

Carlin et al., Electrodeposition of Cobalt-Aluminum Alloys from Room Temperature Chloroaluminate Molten Salt, J. Electrochem. Soc., vol. 143, No. 9, Sep. 1996, pp. 2747-2758.

Freyland et al., Nanoscale Electrodeposition of Metals and Semiconductors from Ionic Liquids, Electrochimica Acta, vol. 48 (2003), pp. 3053-3061.

Fukui et al., The Effect of Organic Additives in Electrodeposition of Co From an Amide-Type Ionic Liquid, Electrochimica Acta, vol. 56 (2011), pp. 1190-1196.

Gallant et al., A Study on the Localized Corrosion of Cobalt in Bicarbonate Solutions Containing Halide Ions, Corrosion Science , vol. 47 (2005), pp. 1810-1838.

Gallant et al., Analysis of a Complex Electrochemical Process: The Anodic Dissolution and Passivation of Cobalt in H2CO3/HCO—3/CO2—3 Aqueous Media Near Neutral pH, Corrosion Science, vol. 48 (2006), pp. 2547-2559.

Gervasi et al., The Electrochemical Behaviour of Cobalt in Carbonate-Bicarbonate Solutions, Corrosion Science, vol. 29, No. 4 (1989) pp. 427-443.

Hussey et al., Electrochemical and Spectroscopic Studies of Cobalt (II) in Molten Aluminum Chloride-N-n-Butylpyridinium Chloride, Inorg. Chem., vol. 20 (1981), pp. 4201-4206.

Katayama et al., Electrodeposition of Cobalt from an Imide-Type Room-Temperature Ionic Liquid, Journal of the Electrochemical Society, vol. 154, No. 10, (2007) pp. D534-D537.

Larramona et al., An In-Situ Spectroscopic Study of the Anodic Oxide Film on a Cobalt Electrode at pH 4-14 by Potential-Modulated Reflectance, J. Electroanal. Chem., vol. 293 (1990), pp. 237-252.

An et al., Electrodeposition of Cobalt in an Ionic Liquid Electrolyte at Ambient Temperature, Chinese Journal of Chemistry, vol. 26 (2008), pp. 1219-1224.

Meier et al., The Electrochemical Behaviour of Cobalt in Alkaline Solutions, J. Electroanal. Chem. vol. 134 (1982), pp. 251-272.

Mitchell et al., Electrodeposition of Cobalt and Cobalt-Aluminum Alloys from a Room Temperature Chloroaluminate Molten Salt, J. Electrochem. Soc., vol. 143, No. 11, Nov. 1996, pp. 3448-3455.

Ong et al., Electrochemical Windows of Room-Temperature Ionic Liquids from Molecular Dynamics and Density Functional Theory Calculations, Chemistry of Materials, vol. 23, No. 11 (2011), pp. 2979-2986.

Sato et al., Anodic Oxidation of Cobalt in Neutral and Basic Solution, J. Electrochem. Soc., vol. 125, No. 11, Nov. 1978, pp. 1735-1740.

Sazou et al., Periodic and Aperiodic Current Oscillations Induced by the Presend of Chloride Ions During Electrodissolution of a Cobalt Electrode in Sulphuric Acid Solutions, J. Electroanal. Chem., vol. 312 (1991) pp. 185-203.

Schaltin et al., Influence of the Anion on the Electrodeposition of Cobalt from Imidazolium Ionic Liquids, Electrochemical and Solid-State Letters, vol. 10, No. 10, (2007). pp. D104-D107.

Simka et al., Electrodeposition of Metals from Non-Aqueous Solutions, Electrochimica Acta, vol. 54 (2009), pp. 5307-5319.

Tsuda et al., Electrochemical Applications of Room-Temperature Ionic Liquids, The Electrochemical Society Interlace, Spring 2007, pp. 42-49.

Zell et al., In situ STM and STS Study of Co and Co—Al Alloy Electrodeposition from an Ionic Liquid, Langmuir, vol. 19 (2003), pp. 7445-7450.

International Search Report for International Application No. PCT/US2013/039486 dated Sep. 16, 2013, 5 pages.

International Written Opinion for International Application No. PCT/US2013/039486 dated Sep. 16, 2013, 4 pages.

International Preliminary Report on Patentability for International Application No. PCT/US2013/039486, dated Nov. 4, 2014, 5 pages.

* cited by examiner

METHODS OF FORMING CUTTING ELEMENTS BY OXIDIZING METAL IN INTERSTITIAL SPACES IN POLYCRYSTALLINE MATERIAL

CROSS-REFERENCE TO RELATED APPLICATION

This application is a continuation of U.S. patent application Ser. No. 13/464,483, filed May 4, 2012, now U.S. Pat. No. 8,961,630, issued Feb. 24, 2015, the disclosure of which is hereby incorporated herein in its entirety by this reference.

FIELD

The present disclosure relates generally to methods for removing metal from interstitial spaces in bodies of polycrystalline diamond, to cutting elements formed using such methods, and to tools for use in earth-boring operations, such as rotary drill bits, that include such cutting elements.

BACKGROUND

Earth-boring tools for forming boreholes in subterranean earth formations, such as for oil and gas extraction, carbon dioxide sequestration, etc., often include a plurality of cutting elements secured to a body. For example, fixed-cutter earth-boring rotary drill bits (also referred to as "drag bits") include cutting elements fixed to a bit body of the drill bit. Earth-boring tools include, but are not limited to, core bits, bi-center bits, eccentric bits, hybrid bits (e.g., rolling components in combination with fixed cutting elements), roller cone bits, reamer wings, expandable reamers, and casing milling tools. As used herein, the terms "earth-boring tool" and "drilling tool" encompass all of the foregoing, and equivalent structures.

Cutting elements for earth-boring tools may include a body of polycrystalline diamond. Such cutting elements are often referred to in the art as "polycrystalline diamond compact" (PDC) cutting elements, and often include a volume of polycrystalline diamond that is formed on an end of a supporting substrate. PDC cutting elements formed on a substrate commonly comprise a thin, substantially circular disc of polycrystalline diamond (although other configurations may also be used), commonly termed a diamond "table," which includes a layer of polycrystalline diamond. Polycrystalline diamond includes diamond grains (i.e., crystals) that are bonded together by direct inter-granular diamond-to-diamond bonds. The direct inter-granular diamond-to-diamond bonds are formed by subjecting the individual diamond grains to what is referred to in the art as a high-temperature and high-pressure (HTHP) process, while the diamond grains are in the presence of a metal solvent catalyst (e.g., a Group VIII metal such as iron, cobalt, or nickel). Upon forming the polycrystalline diamond, the metal solvent catalyst may remain in interstitial spaces between the interbonded diamond grains. At least a portion of the polycrystalline diamond is employed as a cutting edge to cut the subterranean formation being drilled by a drill bit on which the PDC cutting element is mounted.

The presence of the metal solvent catalyst in the interstitial spaces within the polycrystalline diamond may lead to thermal degradation of the polycrystalline diamond commencing at about 400° C. due to differences in the coefficients of thermal expansion (CTEs) of the diamond and the catalyst. Beginning at temperatures of around 700° C. to 750° C., the catalyst may convert diamond to graphitic forms of carbon. Such temperatures may be reached within the polycrystalline diamond in a PDC cutting element during drilling of a formation due to the friction between the PDC cutting element and the formation.

To avoid such thermal degradation, it is known to remove catalyst material from the interstitial spaces between the interbonded diamond grains in polycrystalline diamond material using acid-leaching processes. In such processes, at least a portion of a body of polycrystalline diamond may be immersed in an acidic solution containing hydrofluoric acid, hydrochloric acid, nitric acid, mixtures of acids, etc. Examples of such processes are described in, for example, International Publication Number WO 2007/042920 A1, published Apr. 19, 2007, and entitled "Method of Making a Modified Abrasive Compact," the entire disclosure of which is hereby incorporated by reference.

Removal of the catalyst from the polycrystalline diamond, particularly at the surfaces thereof that will contact the formation during use, reduces the tendency of those portions of the polycrystalline diamond to degrade during drilling. However, removal of substantially all of the catalyst from the polycrystalline diamond may render the polycrystalline diamond less tough and less resistant to fracture, which may be particularly undesirable in certain drilling applications.

BRIEF SUMMARY

In some embodiments of the disclosure, a method of forming a cutting element includes immersing at least a portion of a volume of polycrystalline diamond in a liquid electrolytic solution, applying a voltage between the volume of polycrystalline diamond and a cathode in contact with the liquid electrolytic solution, and removing at least a portion of a metal catalyst from interstitial spaces between adjacent diamond grains in the polycrystalline diamond. The volume of polycrystalline diamond comprises interbonded diamond grains and metal catalyst material in the interstitial spaces between adjacent diamond grains in the polycrystalline diamond.

In other embodiments, methods include forming a barrier over a portion of a volume of polycrystalline diamond, immersing the volume of polycrystalline diamond in a liquid electrolyte, applying an electrical current to the volume of polycrystalline diamond, and transferring at least a portion of a metal catalyst from a portion of the volume of polycrystalline diamond not covered by the barrier to the liquid electrolyte.

In certain embodiments, methods include encapsulating a volume of polycrystalline diamond in a barrier, selectively removing a portion of the barrier from a first portion of the volume of polycrystalline diamond, immersing the volume of polycrystalline diamond in a liquid electrolyte, applying an electrical current to the volume of polycrystalline diamond, and transferring at least a portion of the metal catalyst from the first portion of the volume of polycrystalline diamond to the liquid electrolyte.

BRIEF DESCRIPTION OF THE DRAWINGS

While the specification concludes with claims particularly pointing out and distinctly claiming what are regarded as embodiments of the disclosure, various features and advantages of embodiments of the disclosure may be more readily ascertained from the following description of some embodiments when read in conjunction with the accompanying drawings, in which:

DETAILED DESCRIPTION

The illustrations presented herein are not actual views of any particular material, cutting element, bit body, blades, or drill bit, and are not drawn to scale, but are merely idealized representations employed to describe embodiments of the disclosure. Elements common between figures may retain the same numerical designation.

Cutting elements for drill bits may be prepared by immersing at least a portion of a polycrystalline material (e.g., polycrystalline diamond) in a liquid electrolyte solution, applying a voltage between the polycrystalline material and an electrode immersed within the liquid electrolytic solution, and removing at least a portion of metal catalyst from interstitial spaces between adjacent grains of the polycrystalline material.

Figure 1:
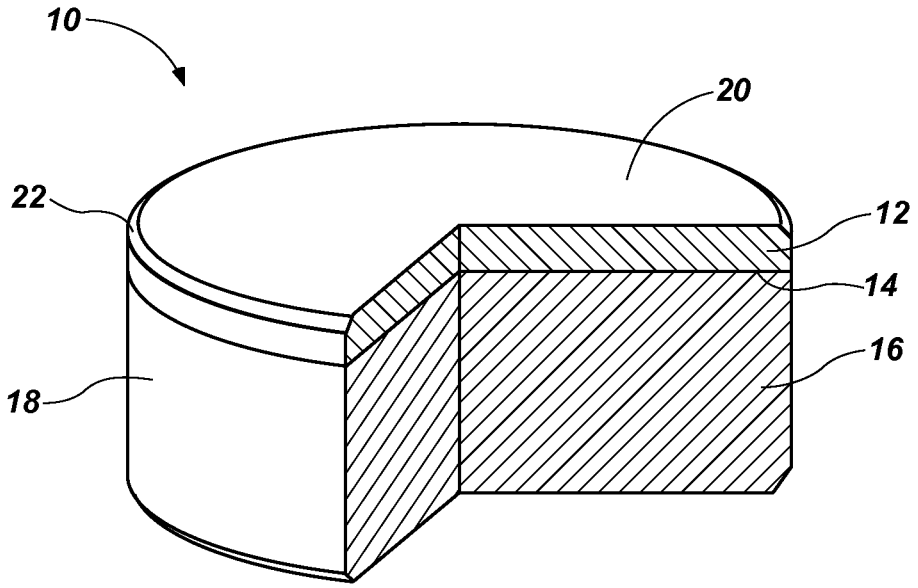
FIG. 1 is a partial cut-away perspective view illustrating an embodiment of a cutting element comprising a polycrystalline diamond compact in which metal solvent catalyst has been removed from interstitial spaces between interbonded diamond grains in the polycrystalline diamond compact using methods as disclosed herein.

FIG. 1 is a simplified, partially cut-away perspective view of a cutting element 10. The cutting element 10 includes a polycrystalline compact in the form of a layer of hard polycrystalline material 12, also known in the art as a polycrystalline table, that is provided on (e.g., formed on or attached to) a supporting substrate 16 with an interface 14 therebetween. Though the cutting element 10 in the embodiment depicted in FIG. 1 is cylindrical or disc-shaped, in other embodiments, the cutting element 10 may have any desirable shape, such as a dome, cone, chisel, etc.

In some embodiments, the hard polycrystalline material 12 comprises polycrystalline diamond, such as natural diamond, synthetic diamond, or a mixture of natural and synthetic diamond. In such embodiments, the cutting element 10 may be referred to as a PDC (polycrystalline diamond compact) cutting element. In other embodiments, the hard polycrystalline material 12 may comprise another hard material, such as polycrystalline cubic boron nitride.

In some embodiments, the hard polycrystalline material 12 may include interbonded grains of hard material, and may have catalyst interspersed between adjacent grains of hard material. The hard polycrystalline material 12 may be formed by compressing a mixture of grains of hard material and catalyst at high temperature, by high-temperature/high-pressure (HTHP) processing. For example, the grains of hard material may, before compression, have a uniform, mono-modal grain size distribution. In some embodiments, the grains of hard material may have a multi-modal (e.g., bi-modal, tri-modal, etc.) grain size distribution. For example, the hard polycrystalline material 12 may comprise a multi-modal grain size distribution as disclosed in at least one of U.S. Patent Application Publication No. 2011/0031034, titled "Polycrystalline Compacts Including In-Situ Nucleated Grains, Earth-Boring Tools Including Such Compacts, and Methods of Forming Such Compacts and Tools," published Feb. 10, 2011; U.S. Patent Application Publication No. 2011/0042149, titled "Methods of Forming Polycrystalline Diamond Elements, Polycrystalline Diamond Elements, and Earth-Boring Tools Carrying Such Polycrystalline Diamond Elements," published Feb. 24, 2011; U.S. Patent Application Publication No. 2011/0061942, titled "Polycrystalline Compacts Having Material Disposed in Interstitial Spaces Therein, Cutting Elements and Earth-Boring Tools Including Such Compacts, and Methods of Forming Such Compacts," published Mar. 17, 2011; U.S. Patent Application Publication No. 2011/0088954, titled "Polycrystalline Compacts Including Nanoparticulate Inclusions, Cutting Elements and Earth-Boring Tools Including Such Compacts, and Methods of Forming Such Compacts," published Apr. 21, 2011; and U.S. patent application Ser. No. 13/277,010, titled "Polycrystalline Compacts Including Nanoparticulate Inclusions, Cutting Elements and Earth-Boring Tools Including Such Compacts, and Methods of Forming Same," filed Oct. 19, 2011, now U.S. Pat. No. 8,893,829, issued Nov. 25, 2014; the disclosure of each of which is incorporated herein in its entirety by this reference. The hard polycrystalline material 12 may include particles or grains of hard material having a mean particle diameter of about 1 μm or less, about 500 nm or less, or even about 100 nm or less. HTHP processing of a mixture of particles may produce a hard polycrystalline material 12 having a grain size distribution similar to the grain size distribution of the mixture of particles. Hard polycrystalline materials 12 formed from smaller grains (or from multi-modal mixtures including at least one plurality of smaller grains) may have smaller voids, or interstitial spaces, between grains, than hard polycrystalline materials 12 formed from larger grains. Thus, removal of the catalyst from such smaller voids by conventional processes may be relatively more difficult.

The catalyst may be a metal or alloy of a Group VIII metal conventionally employed in polycrystalline compact fabrication (e.g., iron, cobalt, nickel, etc.), or other Group VIII metal or alloy thereof, and the catalyst may be supplied in the supporting substrate 16, if a substrate is employed. In some embodiments, powdered catalyst material may be admixed with the grains of hard material prior to HTHP processing. The catalyst may be disposed within interstitial spaces between adjacent grains of hard material in the polycrystalline material.

Cutting elements 10 may include one or more external surfaces, such as flat surfaces, cylindrical surfaces, bevels, etc. For example, a cutting element 10 having an approximately cylindrical shape, as shown in FIG. 1, may have a sidewall 18, a cutting face 20, and/or a bevel 22. The bevel 22, which is generally characterized by those working in the art as a "chamfer," may be located between the cutting face 20 and the sidewall 18 of the hard polycrystalline material 12. The line of interface between the bevel 22 and the outer boundary of the cutting face 20 may define a cutting edge when the cutting element 10 is in a pristine, unworn condition and is mounted on a tool for drilling or reaming a subterranean formation, such as a rotary fixed-cutter, or "drag," bit. The presence of a chamfer at the cutting edge has demonstrated a reduced tendency toward chipping of a diamond table, as has the use of multiple, contiguous chamfers proximate the cutting edge, a radiused or other arcuate transition proximate the cutting edge, and even a combination of chamfers with an intermediate radius.

Figure 2:
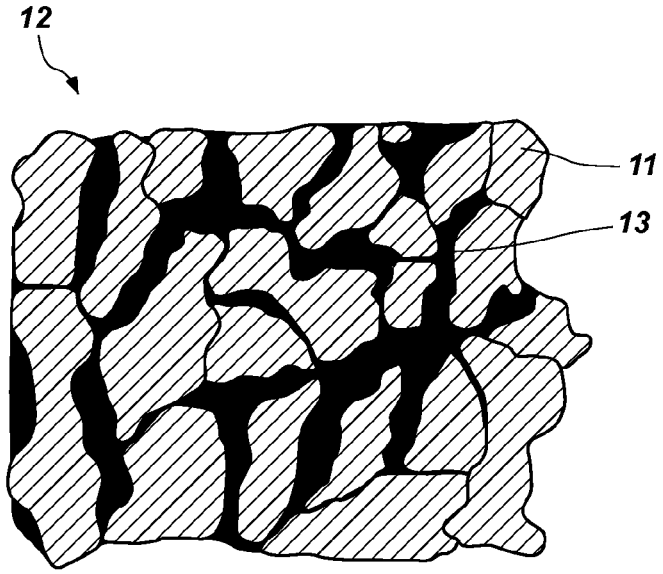
FIG. 2 is a simplified figure illustrating how a microstructure of a region or layer of polycrystalline material of the cutting element shown in FIG. 1 may appear under magnification before removal of the metal solvent catalyst.

FIG. 2 is an enlarged view illustrating how a microstructure of the hard polycrystalline material 12 shown in FIG. 1 may appear under magnification. As shown in FIG. 2, the hard polycrystalline material 12 may include diamond crystals 11 or grains that are bonded together by inter-granular diamond-to-diamond bonds. A catalyst material 13 (the shaded regions between the diamond crystals 11) used to catalyze the formation of the inter-granular diamond-to-diamond bonds is disposed in interstitial regions or spaces between the diamond crystals 11.

As used herein, the term "catalyst material" refers to any material that is capable of catalyzing the formation of inter-granular diamond bonds in a diamond grit or powder during an HTHP process. By way of example, the catalyst material 13 may include cobalt, iron, nickel, or an alloy or mixture thereof. The catalyst material 13 may comprise elements other than elements from Group VIII of the Periodic Table of the Elements, including alloys or mixtures thereof.

Figure 3:
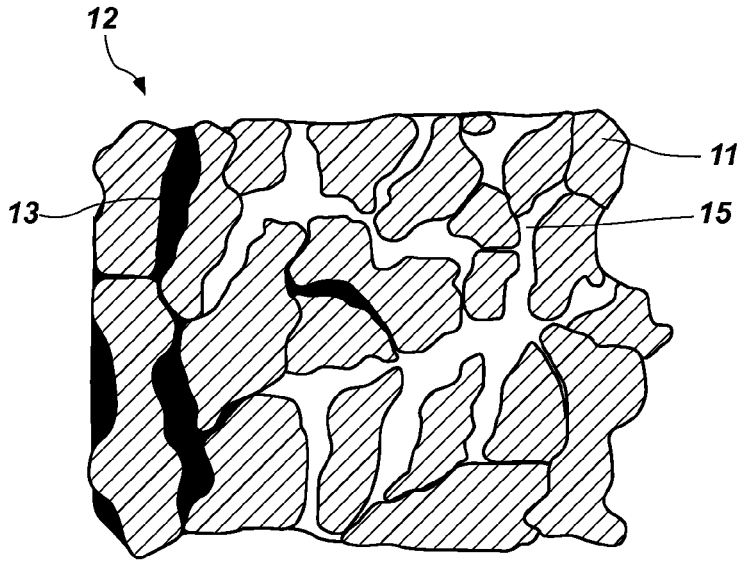
FIG. 3 is a simplified figure illustrating how a microstructure of a region or layer of polycrystalline material of the cutting element shown in FIG. 1 may appear under magnification after removal of catalyst material.

FIG. 3 is an enlarged view illustrating how a microstructure of the hard polycrystalline material 12 shown in FIG. 1 may appear under magnification after removal of some of the catalyst material 13. As shown in FIG. 3, after removal of at least a portion of the catalyst material 13 using embodiments of the methods described herein, cavities or voids 15 may be present in interstitial regions or spaces between the diamond crystals 11. The methods disclosed herein enable removal of the catalyst material 13 from the hard polycrystalline material 12 at temperatures of less than or equal to 750° C., which prevents internal stress within the cutting element (e.g., reverse graphitization) caused by increased temperatures.

Figure 4:
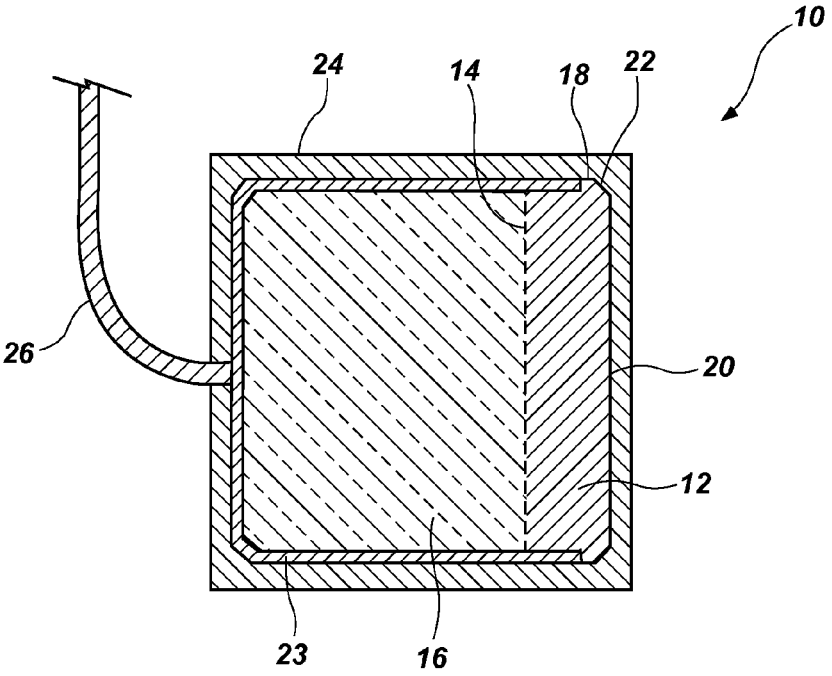
FIG. 4 is simplified cross-sectional view illustrating a cutting element including a body of polycrystalline diamond encapsulated within a barrier material with a conductive member extending through the barrier material and in electrical contact with the cutting element.

A conductive material 23 may optionally be formed over a portion of the cutting element 10, as shown in the simplified cross section of FIG. 4. The conductive material 23 may be any material that conducts electrons. The conductive material 23 may be foil, a wire, a mesh, or a material in any other configuration. The conductive material 23 may or may not entirely surround the supporting substrate 16. The conductive material 23 may be in contact with the hard polycrystalline material 12. A barrier 24 may be formed over the cutting element 10, including over the optional conductive material 23. The barrier 24 may partially or entirely encapsulate conductive material 23 (if present), the hard polycrystalline material 12, and/or the supporting substrate 16. The barrier 24 may be a material formulated to prevent the transfer of catalyst material 13 (FIGS. 2 and 3) from regions of the cutting element 10 covered by the barrier 24. For example, the barrier 24 may be an electrically insulating material, such as a polymer, a wax, an epoxy, a ceramic, glass, a composite material, a diamond-like coating, or any combination thereof, etc. The barrier 24 may limit contact with an electrolyte solution, described in detail below, to only certain portions of the cutting element 10, such as those portions from which removal of catalyst material 13 is desirable. A conductive member 26 may be electrically connected to the cutting element 10 through the barrier 24, such as via the conductive material 23. FIG. 4 shows the conductive member 26 in physical contact with the conductive material 23 over a face of the supporting substrate 16, but the conductive member 26 may be connected to the cutting element 10 at any point. The conductive material 23 may be omitted if the supporting substrate 16 itself is conductive, or if the conductive member 26 is in physical contact with the hard polycrystalline material 12. In some embodiments, the conductive member 26 may be a wire, a bracket, a beam, etc. The conductive member 26 may be insulated to prevent contact with the electrolyte solution.

Figure 5:
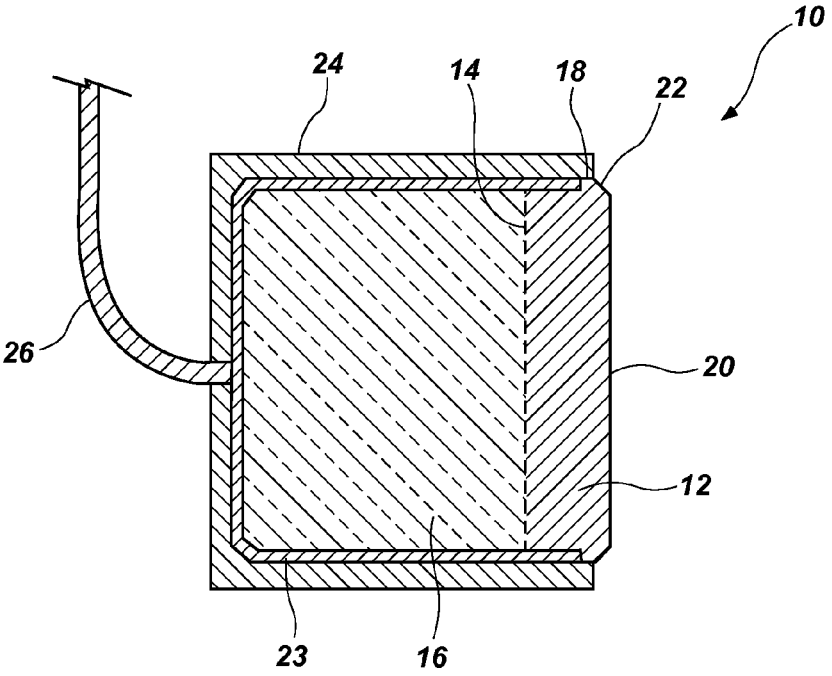
FIG. 5 is similar to FIG. 4 and illustrates a portion of the barrier material removed from surfaces of the body of polycrystalline diamond.

As shown in FIG. 5, a portion of the barrier 24 may be removed, exposing a portion of the cutting element 10. For example, the barrier 24 may be removed from the cutting face 20, the bevel 22, and/or the sidewall 18 of the hard polycrystalline material 12, or from portions of any of such surfaces. The barrier 24 may remain over portions of the cutting element 10 from which catalyst material 13 (FIGS. 2 and 3) is not to be removed and over the conductive material 23. For example, in subsequent processing of the cutting element 10 shown in FIG. 5, catalyst material 13 may be removed from the cutting face 20 and the bevel 22 of the hard polycrystalline material 12, but may not be removed from the sidewall 18 of the hard polycrystalline material 12, from the supporting substrate 16, or from the interface 14 between the hard polycrystalline material 12 and the supporting substrate 16. In some embodiments, the barrier 24 may be formed over only a portion of the cutting element 10, such that removal of a portion of the barrier 24 is unnecessary.

Figure 6:
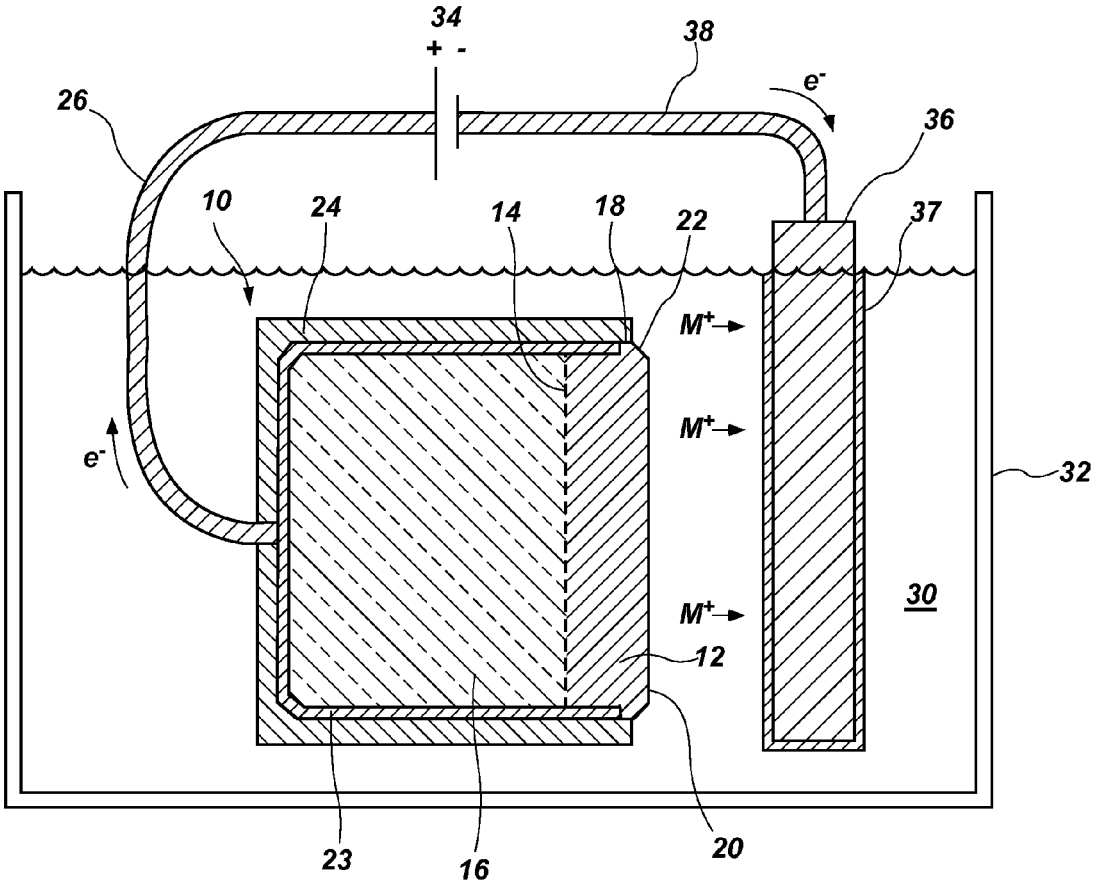
FIG. 6 is a schematically illustrated and simplified cross-sectional view of a system that may be used to electrolytically remove catalyst material from interstitial spaces in the body of polycrystalline diamond of the cutting element of FIGS. 4 and 5, and illustrates the assembly of FIG. 5 immersed in a liquid electrolyte solution while a voltage is applied between the cutting element and another electrode also immersed within the liquid electrolyte solution.

As shown in FIG. 6, the cutting element 10 may be disposed in contact with a liquid electrolytic solution 30, such as by immersing at least a portion of the cutting element 10 in the liquid electrolytic solution 30. The liquid electrolytic solution 30 may be contained within a vessel 32. The liquid electrolytic solution 30 may be formulated to promote the reaction and/or dissolution of catalyst material 13 (FIGS. 2 and 3) from within the cutting element 10. For example, the liquid electrolytic solution 30 may be an acidic aqueous solution or organic and/or inorganic salts, a non-aqueous ionic liquid, a molten salt, any combination thereof, etc. The liquid electrolytic solution 30 may be a solution comprising at least one of halide ions (e.g., chloride ions, fluoride ions, etc.), bicarbonate ions, sulfate ions, hypophosphite ions, ions of another inorganic salt, etc. In some embodiments, the liquid electrolytic solution 30 may include sulfuric acid and chloride ions.

The liquid electrolytic solution 30 may be a room-temperature ionic liquid, i.e., a compound composed of ions that exists in liquid state near room temperature (e.g., near 25° C.). For example, the liquid electrolytic solution 30 may include an aluminum halide (e.g., aluminum chloride) and a corresponding halide salt of an organic cation (e.g., alkylpyridinium or 1,3-dialkylimidazolium). In some embodiments, the liquid electrolytic solution 30 may include anions such as, without limitation, $BF_4^-$; $PF_6^-$; $AsF_6^-$; $N(SO_2CF_3)_2^-$; $C(SO_2CF_3)_3^-$; $CH_3CO_2^-$; $CF_3CO_2^-$; $CH_3SO_3^-$; $CF_3SO_3^-$; $CF_3CF_2CF_2CO_2^-$; $CF_3CF_2CF_2CF_2SO_3^-$; $SCN^-$; $CH_3C_6H_4SO_3^-$; $N(CN)_2-$; $N(SO_2C_2F_5)_2^-$; $H(HF)_n^-$; $Co(CO)_4^-$; etc. In some embodiments, the liquid electrolytic solution 30 may include cations such as, without limitation, quaternary-onium cations in which the central atom is nitrogen, phosphorous, or sulfur; imidazolium; 1,3-dialkylimidazolium (e.g., 1-methyl-3-ethylimidazolium); 1,2,3-trialkylimidazolium; 1,3,4-trialkylimidazolium; 1-alkyl-3-methoxyalkylimidazolium; 1-butyl-3-methylimidazolium; 1-(2,2,2-trifluoroethyl)-3-methylimidazolium; 1-(ω-phenylalkyl)-3-methylimidazolium; 1-methyl-3-[2,6-(S)-dimethylocten-2-yl]imidazolium; N-alkylpyridinium; tetraalkylammonium; methoxyalkyltrialkylammonium; 1,3-dialkylpyrrolidinium; tetraalkylphosphonium; trialkylsulfonium; $Co(4,4'-(CH_3(OCH_2CH_2)_7OCO)_2\text{-}2,2'\text{-bipyridine})^{2+}$; $Fe(4,4'-(CH_3(OCH_2CH_2)_7OCO)_2\text{-}2,2'\text{-bipyridine})^{2+}$; $(N,N'—(CH_3(OCH_2CH_2)_3)_2\text{-}4,4'\text{-bipyridine})^{2+}$; N,N-propylmethylpyrrolidinium; etc. Room-temperature ionic liquids are described in, for example, Marisa C. Buzzeo et al., "Non-Haloaluminate Room-Temperature Ionic Liquids in Electrochemistry—A Review," 5 ChemPhysChem 1106-20 (Wiley-VCH Verlag 2004); Shuye Ping Ong et al., "Electrochemical Windows of Room-Temperature Ionic Liquids from Molecular Dynamics and Density Functional Theory Calculations," 23 Chemistry of Materials 2979-86 (Am. Chemical Soc. 2011); John A. Mitchell et al., "Electrodeposition of Cobalt and Cobalt-Aluminum Alloys from a Room Temperature Chloroaluminate Molten Salt," 143 J. Electrochem. Soc., 3448-55 (Electrochemical Soc. 1996); W. Freyland et al., "Nanoscale electrodeposition of metals and semiconductors from ionic liquids," 48 Electrochimica Acta 3053-61 (Elsevier 2003); and Wojciech Simka, "Electrodeposition of metals from non-aqueous solutions," 54 Electrochimica Acta 5307-19 (Elsevier 2009); the entire contents of each of which are incorporated herein by reference. For example, the liquid electrolytic solution 30 may include aluminum chloride-1-methyl-3-ethylimidazolium chloride, aluminum chloride-1-butyl-3-methylimidazolium chloride, or 1-butyl-3-methylimidazolium hexafluorophosphate. The liquid electrolytic solution 30 may exhibit Lewis-acidic or Lewis-basic characteristics. In some embodiments, the liquid electrolytic solution 30 may include dimethylamine borane, hydrazine, etc.

The liquid electrolytic solution 30 may be selected to have a wider electrochemical window than aqueous electrolytes. The electrochemical window is defined as the difference between the cathodic and anodic limits (i.e., the difference between the potentials at which reduction and oxidation of the solvent occur). Outside the electrochemical window, a solvent may be electrolyzed, wasting the electrical energy that is intended for another electrochemical reaction. Furthermore, electrolysis of water may be a source of explosive hydrogen gas. A wider electrochemical window may facilitate application of a higher voltage between the cathode and the anode without electrolysis. Thus, a higher ionic current may be provided, and a higher corrosion rate of anode (a catalyst) may be achieved. With regard to the electrochemical window of room-temperature ionic liquids, tertraalkylammonium-, dialkylpyrrolidinium-, and dialkylpiperidinium-based ionic liquids typically exhibit superior electrochemical stability relative to imidazolium-based room-temperature ionic liquids. Without being bound to a particular theory, it is believed that the higher electrochemical stability of some room-temperature ionic liquids is due to their superior resistance toward reduction compared to cations based on aromatic heterocyclic species (provided that the accompanying anions are not reduced before the cations). However, the conductivities of tertraalkylammonium-, dialkylpyrrolidinium-, and dialkylpiperidinium-based ionic liquids are usually inferior to the imidazolium- and sulfonium-based room-temperature ionic liquids, which illustrate a trade-off between stability and favorable transport properties. Furthermore, the liquid electrolytic solution 30 may be selected to have a high thermal stability and to have negligible volatility.

In some embodiments, the liquid electrolytic solution 30 may include other ingredients, such as a chelating agent, a surfactant, a base or acid (e.g., to control pH), etc. For example, the liquid electrolytic solution 30 may be as described in U.S. Pat. No. 6,406,611, titled "Nickel Cobalt Phosphorous Low Stress Electroplating," issued Jun. 18, 2002, the entire disclosure of which is hereby incorporated by reference.

Without being bound to a particular theory, it is believed that a liquid electrolytic solution 30 including bicarbonate and chloride species may promote removal and dissolution of metals or metal oxides. For example, such solutions are described in Danick Gallant and Stephan Simard, "A study on the localized corrosion of cobalt in bicarbonate solutions containing halide ions," 47 Corrosion Science 1810-38 (Elsevier 2005), the entire contents of which are incorporated herein by reference.

The liquid electrolytic solution 30 may be maintained at a temperature at which the catalyst may be removed from the cutting element 10. For example, the liquid electrolytic solution 30 may be maintained at temperatures of from about 250° C. to about 750° C., such as about 400° C. In some embodiments, the liquid electrolytic solution 30 may be maintained at a lower temperature. For example, the liquid electrolytic solution 30 may be maintained at a temperature of less than about 200° C., less than about 100° C., less than about 50° C., or less than about 30° C. Processing of cutting elements 10 at lower temperatures may cause lower stresses than processing at higher temperatures. The liquid electrolytic solution 30 may therefore be formulated to promote the reaction and/or dissolution of catalyst at a low temperature.

A voltage may be applied between the cutting element 10 or a portion thereof and a cathode 36 via the liquid electrolytic solution 30. For example, a power supply 34 may apply a voltage through a circuit including the conductive member 26, the conductive material 23, the exposed surfaces of the hard polycrystalline material 12, the liquid electrolytic solution 30, the cathode 36, and a conductive member 38. The cutting element 10 or a portion thereof may serve as an anode. Current may flow through the circuit, driven by the power supply 34. The power supply 34 may include a battery, a function generator, an AC-to-DC converter, etc., and may provide direct current through the circuit. The cathode 36 may be any conductive material. For example, the cathode 36 may be a metal plate or rod, such as a plate or rod comprising platinum, aluminum, or another conductive material. In some embodiments, the cathode 36 may be the vessel 32. In other words, the vessel 32 may be a conductive material electrically connected to the power supply 34, and a separate cathode 36 may be unnecessary. In some embodiments, a semi-permeable membrane and/or ion-exchange membrane may be disposed between the cutting element 10 and the cathode 36 to keep the liquid electrolytic solution 30 separated into two half cells. A semi-permeable membrane may allow some ions to pass, but may block the transfer of other ions. For example, small ions may permeate the semi-permeable membrane, but larger or bulkier ions may not. An ion-exchange membrane may remove certain ions (e.g., toxic ions) from the liquid electrolytic solution 30.

Application of a voltage between the cutting element 10 and the cathode 36 may increase an oxidation state of a portion of the catalyst material 13 (FIGS. 2 and 3). For example, if the catalyst material 13 is cobalt, the voltage may convert Co to $Co^{2+}$ or $Co^{3+}$. The oxidation state of the catalyst material 13 may be increased by the flow of electrons.

Electron and ion flow are illustrated by arrows marked $e^-$ and $M^+$, respectively, in FIG. 6. Upon application of a voltage, electrons $e^-$ flow from the negative side of the power supply 34 (e.g., the negative terminal of a battery) to the cathode 36. Electrons $e^-$ also flow from the cutting element 10 to the positive side of the power supply 34 (e.g., the positive terminal of a battery). Furthermore, ions $M^+$ (which may have an electronic charge of 1+, 2+, 3+, etc.) of the catalyst material 13 (FIGS. 2 and 3) flow in the liquid electrolytic solution 30 from the exposed portion of the cutting element 10 toward the cathode 36. Electrons $e^-$ flowing from the power supply 34 may reduce the ions $M^+$ at the cathode 36 to a neutral metal M (i.e., a metal M having a net zero charge). In some embodiments, the catalyst material 13 may be deposited onto the cathode 36 or another solid surface. For example, the catalyst material 13 may form a layer 37 over at least a portion of the cathode 36. Cations of the electrolytic solution 30 move toward the cathode 36 and anions move toward the cutting element 10, which serves as the anode. Without being bound to a particular theory, it is believed that anions may facilitate the transfer of cations of the catalyst material 13 from the solid state into the electrolytic solution 30.

Application of a voltage may increase the oxidation state of catalyst material 13 (FIGS. 2 and 3) in a layer of the hard polycrystalline material 12 exposed to the liquid electrolytic solution 30. That is, catalyst material 13 in the hard polycrystalline material 12 may be converted from a metal M having a net zero charge to a metal ion $M^+$ having a net positive charge (e.g., an electronic charge of 1+, 2+, 3+, etc.). The depth of the material affected by the application of voltage may depend on the magnitude of the voltage, the time over which the voltage is applied, the composition of the liquid electrolytic solution 30, the composition of the hard polycrystalline material 12, the composition of the cathode 36, etc. The power supply 34 may provide a voltage of at least about 0.5 volts, at least about 1.0 volts, or at least about 1.5 volts between the cutting element 10 and the cathode 36. The voltage may be selected based on potential drops at the cutting element 10 and the cathode 36 and within the liquid electrolytic solution 30 (e.g., current through the liquid electrolytic solution 30 multiplied by the resistance of the liquid electrolytic solution 30). Potential drops may vary based on the composition, physical dimensions, spacing, etc., of the cutting element 10, the cathode 36, the liquid electrolytic solution 30, and the current passing therethrough. For example, potential drop due to some cathodes 36 may vary as a function of current.

At least a portion of the catalyst material 13 may be removed from the hard polycrystalline material 12 of the cutting element 10. Catalyst material 13 may be removed from the interstitial spaces between adjacent grains of the hard polycrystalline material 12. For example, catalyst material 13 may be transferred from portions of the hard polycrystalline material 12 not covered by the barrier 24 to the liquid electrolytic solution 30. In some embodiments, catalyst material 13 (e.g., atoms M or ions $M^+$ of catalyst) may dissolve in the liquid electrolytic solution 30. If the catalyst material 13 is cobalt, $Co^{2+}$ or $Co^{3+}$ ions formed by application of voltage may dissolve in the liquid electrolytic solution 30. Without being bound to a particular theory, $Co^{3+}$ ions (if any) may be reduced to $Co^{2+}$ ions in the liquid electrolytic solution 30. $Co^{2+}$ ions may form various complexes with other species present in the liquid electrolytic solution 30. The formulation of the liquid electrolytic solution 30 may be selected to comprise a solution in which the metal ions $M^+$ to be formed will dissolve. Dissolution of metals by the application of voltage is described in, for example, Ryuta Fukui et al., "The effect of organic additives in electrodeposition of Co from an amide-type ionic liquid," 56 Electrochimica Acta 1190-96 (Elsevier 2010), the entire contents of which are incorporated herein by reference.

Catalyst material 13 may be removed from at least one of the sidewall 18, the cutting face 20, and the bevel 22. In some embodiments, catalyst material 13 may be substantially removed from the interstitial spaces between adjacent grains of hard material along an entire exposed surface of the cutting element 10.

Catalyst material 13 may be removed from portions of the hard polycrystalline material 12 adjacent an exposed surface to a desired depth, for example, a depth of from about 40 microns to about 400 microns. For example, a depth of between about 100 microns and about 250 microns is believed to be particularly effective for cutting elements 10 used in some applications. In some embodiments, portions of the hard polycrystalline material 12 may be leached to a depth of 250 microns or greater. In other embodiments, catalyst material 13 may be removed from portions of the hard polycrystalline material 12 to a depth of 100 microns or less. Catalyst removal from one or more portions of the hard polycrystalline material 12 may render such portions of the hard polycrystalline material 12 at least substantially free of catalyst material 13 (but for catalyst material 13 disposed in closed pores within the hard polycrystalline material 12) and enhance thermal stability of the hard polycrystalline material 12 during use, as known to those of ordinary skill in the art. The presence of the catalyst material 13 in another region or regions of the hard polycrystalline material 12 may enhance bulk cutting element toughness and fracture resistance. The barrier 24 may be selectively removed or applied at various points in the catalyst-removal process to control the depth to which catalyst material 13 is removed from various regions of the hard polycrystalline material 12.

Upon removal of catalyst material 13 from portions of the hard polycrystalline material 12 adjacent the liquid electrolytic solution 30, catalyst material 13 may diffuse from other portions of the cutting element 10 (e.g., from deeper within the cutting element 10). Such diffusion may cause the formation of a concentration gradient of catalyst material 13 within the cutting element 10.

In some embodiments, the composition of the liquid electrolytic solution 30 may be varied or controlled during the application of voltage. For example, one or more components may be added to the liquid electrolytic solution 30 to maintain a selected pH, or the liquid electrolytic solution 30 may be continuously passed through the vessel 32.

In some embodiments, catalyst material 13 dissolved in the liquid electrolytic solution 30 or a salt of the catalyst material 13 may be deposited onto a solid surface. For example, catalyst material 13 may be deposited onto a surface of the vessel 32 and/or the cathode 36, such as by reduction of an oxidation state (e.g., from $M^+$ to M) at the cathode 36. The liquid electrolytic solution 30 may be removed from the vessel 32, the catalyst material 13 may be deposited onto another surface, and the liquid electrolytic solution 30 (now having a lower concentration of catalyst material 13) may be returned to the vessel 32. Such a process may operate in a continuous-flow manner.

The following example illustrates an embodiment of how a voltage may be applied between a cutting element 10 and a cathode 36 immersed within a liquid electrolytic solution 30 to remove catalyst material 13 from interstitial spaces between adjacent grains of the polycrystalline material. With continued reference to FIG. 6, the hard polycrystalline material 12 of a cutting element 10 may comprise cobalt-cemented polycrystalline diamond. The cathode 36 may comprise aluminum. The liquid electrolytic solution 30 may comprise a low-melting-point salt, such as $AlCl_3$-1-(1-butyl) pyridinium chloride. Upon application of a voltage from the power supply 34, some of the cobalt catalyst material 13 in the hard polycrystalline material 12 may increase in oxidation state, such as to $Co^{2+}$, as shown in Reaction 1, below:

$$Co_{(s)} \rightarrow Co^{2+} + 2e^- \quad (1).$$

This reaction may occur near the edge of the cutting element 10, and the $Co^{2+}$ may dissolve in the liquid electrolytic solution 30. Electrons $e^-$ flow through the conductive member 26 toward the power supply 34. The $Co^{2+}$ ions (indicated as $M^+$ in FIG. 6) flow through the liquid electrolytic solution 30 toward the cathode 36. At the cathode 36, the reverse reaction occurs:

$$Co^{2+} + 2e^- \rightarrow Co_{(s)} \quad (2).$$

The electrons $e^-$ in Reaction 2 flow from the power supply 34 through the conductive member 38 to the cathode 36. A layer 37 of solid cobalt may deposit onto the cathode 36 as a result of Reaction 2. In some embodiments, the liquid electrolytic solution 30 may include chloride ions, and the $Co^{2+}$ ions may react with the chloride ions to form $CoCl_2$.

Figure 7:
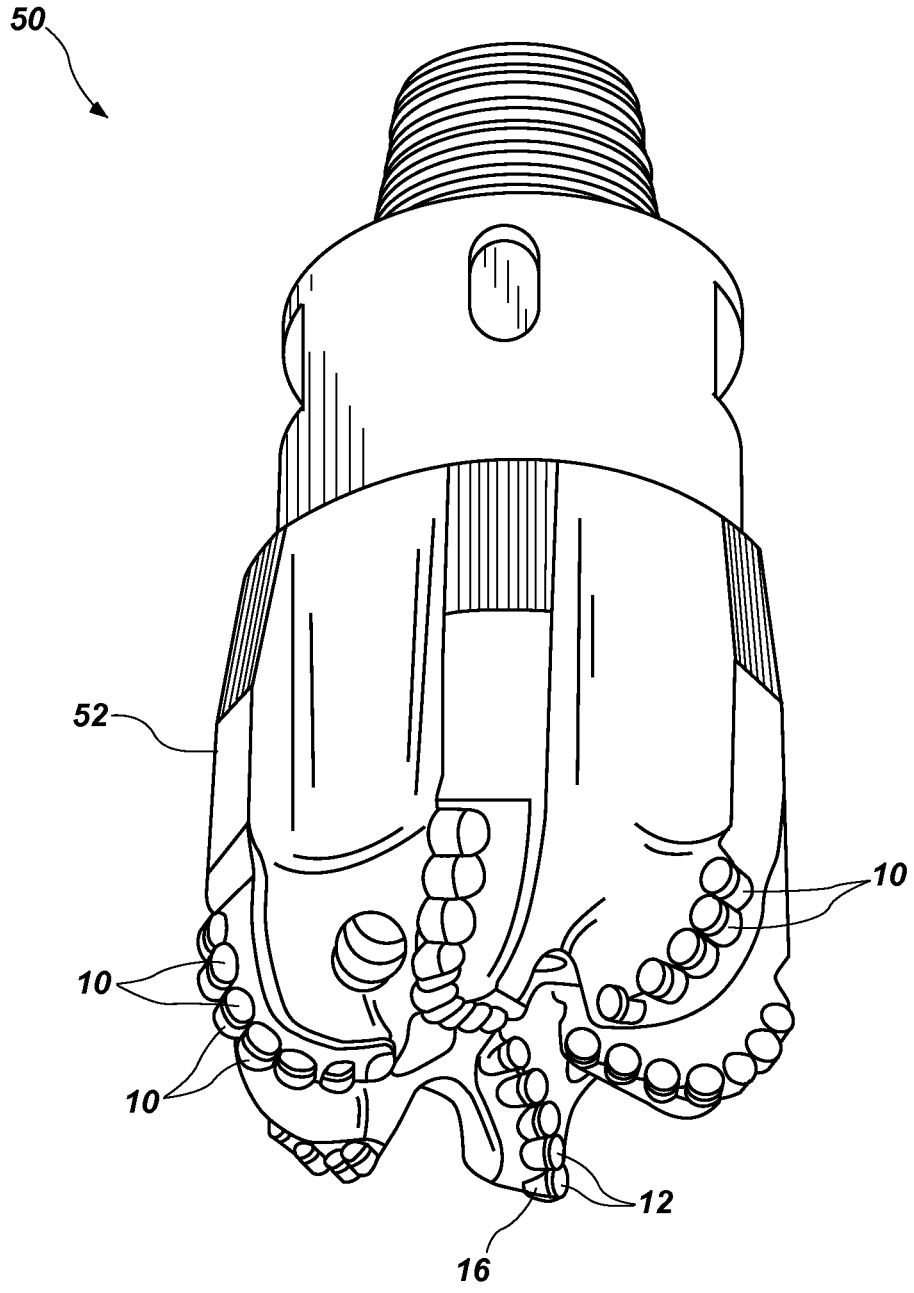
FIG. 7 is a perspective view of an embodiment of a fixed-cutter earth-boring rotary drill bit that includes a plurality of cutting elements like that shown in FIG. 1.

Embodiments of cutting elements 10 of the present disclosure that include a polycrystalline compact comprising hard polycrystalline material 12 formed as previously described herein, such as the cutting element 10 illustrated in FIG. 1, may be formed and secured to an earth-boring tool, such as a rotary drill bit, a percussion bit, a coring bit, an eccentric bit, a reamer tool, a milling tool, etc., for use in forming wellbores in subterranean formations. As a non-limiting example, FIG. 7 illustrates a fixed-cutter-type earth-boring rotary drill bit 50 that includes a plurality of cutting elements 10, each of which includes a hard polycrystalline material 12. The earth-boring rotary drill bit 50 includes a bit body 52 and the cutting elements 10 bonded to the bit body 52. The bit body 52 may comprise a tungsten carbide matrix or a steel body, both as well known in the art. The cutting elements 10 may be brazed or otherwise secured within pockets formed in the outer surface of the bit body 52.

Additional non-limiting example embodiments of the disclosure are described below.

Embodiment 1

A method of forming a cutting element, comprising immersing at least a portion of a volume of polycrystalline diamond in a liquid electrolytic solution, applying a voltage between the volume of polycrystalline diamond and a cathode in contact with the liquid electrolytic solution, and removing at least a portion of metal catalyst material from interstitial spaces between adjacent diamond grains in the volume of polycrystalline diamond. The volume of polycrystalline diamond comprises interbonded diamond grains and the metal catalyst material in the interstitial spaces between adjacent diamond grains in the polycrystalline diamond.

Embodiment 2

The method of Embodiment 1, wherein the volume of polycrystalline diamond comprises at least one of a cutting face, a sidewall, and a chamfer, and wherein removing at least a portion of the metal catalyst material from the interstitial spaces between adjacent diamond grains comprises substantially removing the metal catalyst material from at least one of the cutting face, the sidewall, and the chamfer.

Embodiment 3

The method of Embodiment 1 or Embodiment 2, wherein applying a voltage between the volume of polycrystalline diamond and a cathode in contact with the liquid electrolytic solution comprises applying a voltage of at least 1.5 volts between the volume of polycrystalline diamond and the cathode.

Embodiment 4

The method of any of Embodiments 1 through 3, further comprising compressing a diamond grit mixture with the metal catalyst material to form the volume of polycrystalline diamond, the diamond grit mixture comprising a plurality of diamond grains having a mean particle diameter of about 1 μm or less.

Embodiment 5

The method of any of Embodiments 1 through 4, wherein removing at least a portion of the metal catalyst material from the interstitial spaces between adjacent diamond grains comprises removing a Group VIII metal or alloy from the interstitial spaces.

Embodiment 6

The method of Embodiment 5, wherein removing a Group VIII metal or alloy from the interstitial spaces comprises removing cobalt from the interstitial spaces.

Embodiment 7

The method of any of Embodiments 1 through 6, wherein applying a voltage between the volume of polycrystalline diamond and a cathode in contact with the liquid electrolytic solution comprises increasing an oxidation state of the metal catalyst material.

Embodiment 8

The method of any of Embodiments 1 through 7, wherein immersing at least a portion of a volume of polycrystalline diamond in a liquid electrolytic solution comprises immersing at least a portion of the volume of polycrystalline diamond in an acidic aqueous solution.

Embodiment 9

The method of any of Embodiments 1 through 8, wherein immersing at least a portion of a volume of polycrystalline diamond in a liquid electrolytic solution comprises immersing at least a portion of the volume of polycrystalline diamond in a solution comprising at least one of chloride ions and bicarbonate ions.

Embodiment 10

The method of any of Embodiments 1 through 9, wherein immersing at least a portion of a volume of polycrystalline diamond in a liquid electrolytic solution comprises immersing at least a portion of the volume of polycrystalline diamond in a solution comprising fluoride ions.

Embodiment 11

The method of any of Embodiments 1 through 7, Embodiment 9, or Embodiment 10, wherein immersing at least a portion of a volume of polycrystalline diamond in a liquid electrolytic solution comprises immersing at least a portion of the volume of polycrystalline diamond in a non-aqueous ionic liquid.

Embodiment 12

The method of any of Embodiments 1 through 7 or Embodiments 9 through 11, wherein immersing at least a portion of a volume of polycrystalline diamond in a liquid electrolytic solution comprises immersing at least a portion of the volume of polycrystalline diamond in a molten inorganic salt.

Embodiment 13

The method of any of Embodiments 1 through 12, wherein immersing at least a portion of a volume of polycrystalline diamond in a liquid electrolytic solution comprises immersing at least a portion of the volume of polycrystalline diamond in a liquid electrolytic solution at a temperature of less than about 50° C.

Embodiment 14

The method of any of Embodiments 1 through 13, wherein removing at least a portion of the metal catalyst material from the interstitial spaces between adjacent diamond grains comprises dissolving at least a portion of the metal catalyst material in the liquid electrolytic solution.

Embodiment 15

The method of Embodiment 14, further comprising depositing at least a portion of the metal catalyst material on the cathode.

Embodiment 16

A method of forming a cutting element, comprising forming a barrier over a portion of a volume of polycrystalline diamond, immersing the volume of polycrystalline diamond in a liquid electrolyte, applying an electrical current to the volume of polycrystalline diamond, and transferring at least a portion of metal catalyst from a portion of the volume of polycrystalline diamond not covered by the barrier to the liquid electrolyte. The volume of polycrystalline diamond comprises interbonded diamond grains and the metal catalyst in interstitial spaces between adjacent diamond grains.

Embodiment 17

The method of Embodiment 16, wherein immersing the volume of polycrystalline diamond in a liquid electrolyte comprises immersing the volume of polycrystalline diamond in an ionic liquid comprising at least one of chloride ions, fluoride ions, and bicarbonate ions.

Embodiment 18

The method of Embodiment 16 or Embodiment 17, wherein transferring at least a portion of the metal catalyst from a portion of the volume of polycrystalline diamond not covered by the barrier to the liquid electrolyte comprises increasing an oxidation state of the metal catalyst.

Embodiment 19

The method of any of Embodiments 16 through 18, wherein transferring at least a portion of the metal catalyst from a portion of the volume of polycrystalline diamond not covered by the barrier to the liquid electrolyte comprises diffusing metal catalyst within the volume of polycrystalline diamond.

Embodiment 20

The method of any of Embodiments 16 through 19, further comprising forming a conductive material in electrical contact with the volume of polycrystalline diamond, wherein applying an electrical current to the volume of polycrystalline diamond comprises forming a circuit connecting the volume of polycrystalline diamond to a voltage source via the conductive material.

Embodiment 21

The method of any of Embodiments 16 through 20, wherein immersing the volume of polycrystalline diamond in a liquid electrolyte comprises immersing the volume of polycrystalline diamond in an ionic liquid comprising at least one ion selected from the group consisting of $BF_4^-$; $PF_6^-$; $AsF_6^-$; $N(SO_2CF_3)_2^-$; $C(SO_2CF_3)_3^-$; $CH_3CO_2^-$; $CF_3CO_2^-$; $CH_3SO_3^-$; $CF_3SO_3^-$; $CF_3CF_2CF_2CO_2^-$; $CF_3CF_2CF_2CF_2SO_3^-$; $SCN^-$; $CH_3C_6H_4SO_3^-$; $N(CN)_2-$; $N(SO_2C_2F_5)_2^-$; $H(HF)_n^-$; $Co(CO)_4^-$; etc. imidazolium; 1,3-dialkylimidazolium (e.g., 1-methyl-3-ethylimidazolium); 1,2,3-trialkylimidazolium; 1,3,4-trialkylimidazolium; 1-alkyl-3-methoxyalkylimidazolium; 1-butyl-3-methylimidazolium; 1-(2,2,2-trifluoroethyl)-3-methylimidazolium; 1-(ω-phenylalkyl)-3-methylimidazolium; 1-methyl-3-[2,6-(S)-dimethylocten-2-yl]imidazolium; N-alkylpyridinium; tetraalkylammonium; methoxyalkyltrialkylammonium; 1,3-dialkylpyrrolidinium; tetraalkylphosphonium; trialkylsulfonium; $Co(4,4'-(CH_3(OCH_2CH_2)_7OCO)_2\text{-}2,2'\text{-bipyridine})^{2+}$; $Fe(4,4'-(CH_3(OCH_2CH_2)_7OCO)_2\text{-}2,2'\text{-bipyridine})^{2+}$; $(N,N'—(CH_3(OCH_2CH_2)_3)_2\text{-}4,4'\text{-bipyridine})^{2+}$; N,N-propylmethylpyrrolidinium; and quaternary-onium cations in which the central atom is nitrogen, phosphorous, or sulfur.

Embodiment 22

A method of forming a cutting element, comprising encapsulating a volume of polycrystalline diamond in a barrier, selectively removing a portion of the barrier from a first portion of the volume of polycrystalline diamond, immersing the volume of polycrystalline diamond in a liquid electrolyte, applying an electrical current to the volume of polycrystalline diamond, and transferring at least a portion of the metal catalyst from the first portion of the volume of polycrystalline diamond to the liquid electrolyte. The volume of polycrystalline diamond comprises interbonded diamond grains and metal catalyst in interstitial spaces between adjacent diamond grains.

While the present disclosure has been described with respect to certain embodiments, those of ordinary skill in the art will recognize and appreciate that it is not so limited. Rather, many additions, deletions and modifications to the embodiments described herein may be made without departing from the scope of the invention as hereinafter claimed, including legal equivalents. In addition, features from one embodiment may be combined with features of another embodiment while still being encompassed within the scope of the invention as contemplated by the inventor. Further, embodiments of the disclosure have utility with different and various bit profiles as well as cutting element types and configurations.

What is claimed is:

1. A method of forming a cutting element, comprising:

disposing a volume of polycrystalline material adjacent a non-aqueous ionic liquid, the volume of polycrystalline material comprising interbonded grains of hard material and metal catalyst material in interstitial spaces between adjacent grains of hard material, wherein the non-aqueous ionic liquid comprises at least one ion selected from the group consisting of $BF_4^-$; $PF_6^-$; $AsF_6^-$; $N(SO_2CF_3)_2^-$; $C(SO_2CF_3)_3^-$; $CF_3CO_2^-$; $CH_3SO_3^-$; $CF_3SO_3^-$; $CF_3CF_2CF_2CO_2^-$; $CF_3CF_2CF_2CF_2SO_3^-$; $SCN^-$; $CH_3C_6H_4SO_3^-$; $N(CN)_2^-$; $N(SO_2C_2F_5)_2^-$; $H(HF)_n^-$; $Co(CO)_4^-$; imidazolium; 1,3-dialkylimidazolium 1,2,3-trialkylimidazolium; 1,3,4-trialkylimidazolium; 1-alkyl-3-methoxyalkylimidazolium; 1-butyl-3-methylimidazolium; 1-(2,2,2-trifluoroethyl)-3-methylimidazolium; 1-(ω-phenylalkyl)-3-methylimidazolium; 1-methyl-3-[2,6-(S)-dimethylocten-2-yl]imidazolium; N-alkylpyridinium; tetraalkylammonium; methoxyalkyltrialkylammonium; 1,3-dialkylpyrrolidinium; tetraalkylphosphonium; trialkylsulfonium; $Co(4,4'-(CH_3(OCH_2CH_2)_7OCO)_2\text{-}2,2'\text{-bipyridine})^{2+}$; $Fe(4,4'-(CH_3(OCH_2CH_2)_7OCO)_2\text{-}2,2'\text{-bipyridine})^{2+}$; $(N,N'—(CH_3(OCH_2CH_2)_3)_2\text{-}4,4'\text{-bipyridine})^{2+}$; N,N-propylmethylpyrrolidinium; and quaternary-onium cations in which the central atom comprises nitrogen, phosphorous, or sulfur; and applying an electrical potential between the volume of polycrystalline material and a cathode in electrical contact with the non-aqueous ionic liquid to increase an oxidation state of the metal catalyst material while maintaining the non-aqueous ionic liquid at a temperature of less than about 100° C.

2. The method of claim 1, wherein disposing a volume of polycrystalline material adjacent a non-aqueous ionic liquid comprises disposing a volume of polycrystalline material comprising at least one of a cutting face, a sidewall, and a chamfer adjacent the non-aqueous ionic liquid.

3. The method of claim 2, further comprising removing at least a portion of the metal catalyst material from at least one of the cutting face, the sidewall, and the chamfer.

4. The method of claim 1, wherein applying an electrical potential between the volume of polycrystalline material and a cathode in electrical contact with the non-aqueous ionic liquid comprises applying an electrical potential of at least 1.5 volts between the volume of polycrystalline material and the cathode.

5. The method of claim 1, further comprising compressing a mixture of grains of the hard material with the metal catalyst material to form the volume of polycrystalline material, the mixture comprising a plurality of grains of hard material having a mean particle diameter of about 1 μm or less.

6. The method of claim 1, further comprising removing at least a portion of the metal catalyst material from the interstitial spaces between adjacent grains of hard material in the volume of polycrystalline material.

7. The method of claim 6, wherein removing at least a portion of the metal catalyst material from the interstitial spaces between adjacent grains of hard material comprises dissolving at least a portion of the metal catalyst material in the non-aqueous ionic liquid.

8. The method of claim 7, further comprising depositing at least a portion of the metal catalyst material on the cathode.

9. The method of claim 1, wherein disposing a volume of polycrystalline material adjacent a non-aqueous ionic liquid comprises disposing at least a portion of the volume of polycrystalline material adjacent a solution comprising at least one of chloride ions, fluoride ions, and bicarbonate ions.

10. The method of claim 1, wherein applying an electrical potential between the volume of polycrystalline material and a cathode in electrical contact with the non-aqueous ionic liquid to increase an oxidation state of the metal catalyst material while maintaining the non-aqueous ionic liquid at a temperature of less than about 100° C. comprises maintaining the non-aqueous ionic liquid at a temperature of less than about 50° C.

11. The method of claim 1, wherein disposing a volume of polycrystalline material adjacent a non-aqueous ionic solution comprises disposing a volume of polycrystalline diamond adjacent the non-aqueous ionic liquid.

12. The method of claim 1, wherein disposing a volume of polycrystalline material adjacent a non-aqueous ionic liquid comprises disposing a volume of polycrystalline cubic boron nitride adjacent the non-aqueous ionic liquid.

13. A method of forming a cutting element, comprising:

forming a barrier over a portion of a surface of a volume of polycrystalline material, the volume of polycrystalline material comprising interbonded grains of hard material and metal catalyst in interstitial spaces between adjacent grains of hard material;

disposing the volume of polycrystalline material adjacent a non-aqueous liquid electrolyte comprising at least one ion selected from the group consisting of $BF_4^-$; $PF_6^-$; $AsF_6^-$; $N(SO_2CF_3)_2^-$; $C(SO_2CF_3)_3^-$; $CF_3CO_2^-$; $CH_3SO_3^-$; $CF_3SO_3^-$; $CF_3CF_2CF_2CO_2^-$; $CF_3CF_2CF_2CF_2SO_3^-$; $SCN^-$; $CH_3C_6H_4SO_3^-$; $N(CN)_2^-$; $N(SO_2C_2F_5)_2^-$; $H(HF)_n^-$; $Co(CO)_4^-$; imidazolium; 1,3-dialkylimidazolium 1,2,3-trialkylimidazolium; 1,3,4-trialkylimidazolium; 1-alkyl-3-methoxyalkylimidazolium; 1-butyl-3-methylimidazolium; 1-(2,2,2-trifluoroethyl)-3-methylimidazolium; 1-(ω-phenylalkyl)-3-methylimidazolium; 1-methyl-3-[2,6-(S)-dimethylocten-2-yl]imidazolium; N-alkylpyridinium; tetraalkylammonium; methoxyalkyltrialkylammonium; 1,3-dialkylpyrrolidinium; tetraalkylphosphonium; trialkylsulfonium; $Co(4,4'-(CH_3(OCH_2CH_2)_7OCO)_2\text{-}2,2'\text{-bipyridine})^{2+}$; $Fe(4,4'-(CH_3(OCH_2CH_2)_7OCO)_2\text{-}2,2'\text{-bipyridine})^{2+}$; $(N,N'—(CH_3(OCH_2CH_2)_3)_2\text{-}4,4'\text{-bipyridine})^{2+}$; N,N-propylmethylpyrrolidinium; and quaternary-onium cations in which the central atom comprises nitrogen, phosphorous, or sulfur;

applying an electrical potential to the volume of polycrystalline material to increase an oxidation state of the metal catalyst adjacent another portion of the surface of the volume of polycrystalline material unprotected by the barrier; and maintaining the non-aqueous liquid electrolyte at a temperature of less than about 100° C. while applying the electrical potential to the volume of polycrystalline material.

14. The method of claim 13, wherein disposing the volume of polycrystalline material adjacent a non-aqueous liquid electrolyte comprises disposing the volume of polycrystalline material adjacent an ionic liquid comprising at least one of chloride ions, fluoride ions, and bicarbonate ions.

15. The method of claim 13, further comprising diffusing metal catalyst within the volume of polycrystalline material.

16. The method of claim 13, further comprising forming a conductive material in electrical contact with the volume of polycrystalline material, wherein applying an electrical potential to the volume of polycrystalline material comprises forming a circuit connecting the volume of polycrystalline material to a voltage source via the conductive material.

17. The method of claim 13, wherein maintaining the non-aqueous liquid electrolyte at a temperature of less than about 100° C. while applying the electrical potential to the volume of polycrystalline material comprises maintaining the non-aqueous liquid electrolyte at a temperature of less than about 50° C.

18. The method of claim 13, wherein forming a barrier over a portion of a surface of a volume of polycrystalline material comprises forming an electrically insulating material over a portion of a surface of a volume of polycrystalline material.

19. The method of claim 13, wherein forming a barrier over a portion of a surface of a volume of polycrystalline material comprises forming a material selected from the group consisting of a polymer, a wax, an epoxy, a ceramic, glass, a composite material, and a diamond-like coating.

20. The method of claim 13, further comprising removing the barrier from the polycrystalline material before disposing the volume of polycrystalline material adjacent the non-aqueous liquid electrolyte.

* * * * *